United States Patent [19]

De Fouw et al.

[11] 4,239,309

[45] Dec. 16, 1980

[54] FILING CABINET INCLUDING DRAWER INTERLOCK

[75] Inventors: Eugene A. De Fouw, Holland; Peter M. Baker, Mattawan, both of Mich.

[73] Assignee: Lear Siegler, Inc., Kalamazoo, Mich.

[21] Appl. No.: 62,394

[22] Filed: Jul. 31, 1979

[51] Int. Cl.[3] ..... E05B 65/46; E05C 7/06

[52] U.S. Cl. ..... 312/221; 312/216; 312/219; 312/333

[58] Field of Search ..... 312/219, 218, 216, 221, 312/333, 286, 220, 217; 292/341.15

[56] References Cited

U.S. PATENT DOCUMENTS

| | | | |
|---|---|---|---|
| 2,793,927 | 5/1957 | Reitzel | 312/219 |
| 2,829,021 | 4/1959 | Wolters | 312/218 |
| 3,323,849 | 6/1967 | Stark | 312/221 |
| 3,404,929 | 10/1968 | Wright et al. | 312/216 |
| 3,622,216 | 11/1971 | Haunost | 312/219 |
| 3,764,190 | 10/1973 | Anderson | 312/286 |
| 3,866,993 | 2/1975 | Dean et al. | 312/216 |
| 3,876,387 | 3/1975 | Mortashed | 312/219 X |
| 3,883,200 | 5/1975 | Latham | 312/216 |
| 3,888,558 | 6/1975 | Himsl | 312/221 X |
| 3,936,108 | 2/1976 | Chitester | 312/219 X |
| 3,969,008 | 7/1976 | Pregler | 312/221 |
| 4,134,625 | 1/1979 | Palka | 312/227 X |

FOREIGN PATENT DOCUMENTS

| | | | |
|---|---|---|---|
| 1037092 | 8/1978 | Canada | 312/216 |
| 2044365 | 3/1972 | Fed. Rep. of Germany | 312/219 |

*Primary Examiner*—James T. McCall

*Attorney, Agent, or Firm*—Reising, Ethington, Barnard, Perry & Brooks

[57] ABSTRACT

A file cabinet (10) is disclosed as having a drawer interlock (18) including a plurality of lock members (24) of a unique construction that is preferably unitary and injection molded from plastic. An interlock bar (22) on which the lock members are mounted is received by a plastic sleeve (27) on side panels (14, 28) of the cabinet with the lock members mounted in a vertically spaced relationship in association with drawers (12) of the cabinet, preferably with one such interlock bar at each side of the cabinet. A vertically elongated guide (38) of each lock member extends between vertically elongated slide flanges (32) of the plastic sleeve so as to support the interlock bar for translational movement in a vertical direction between lower and upper positions. Each lock member also including a pair of upwardly extending hooks (44) located laterally inward from the adjacent inner panel. One hook is operable upon actuation of the interlock to engage the associated drawer so as to maintain the drawer closed, while the other hook is provided so that the lock member can likewise function on the other side of the cabinet. Outward movement of any one drawer engages an actuator (26) on the drawer with a slide surface (50) of the associated lock member so as to move the interlock bar to its upper position and thereby lock each other drawer in the closed position. An upper end of each interlock bar includes an opening (62) and an inclined flange (64) above the opening, and a lock mechanism (20) of the cabinet includes actuator members which are received within the bar openings and have inclined surfaces engaged with the inclined flanges on the bars so that movement of the actuator members by a lock moves the interlock bars upwardly in order to lock all of the drawers in the closed position.

11 Claims, 7 Drawing Figures

FILING CABINET INCLUDING DRAWER INTERLOCK

TECHNICAL FIELD

The present invention relates to a file cabinet including an improved drawer interlock for preventing opening movement of any one drawer when another drawer is already opened, and the invention also relates to a lock mechanism that cooperates with the interlock in order to permit security locking of all the drawers in the closed position.

BACKGROUND ART

The prior art discloses file cabinets having drawer interlocks for preventing more than one drawer from being opened at any one time in order to prevent the center of gravity of the cabinet from moving too far forward and possibly tipping the cabinet over. Interlocks for file cabinets have previously incorporated vertically extending interlock bars located at one or both sides of the file cabinet such that vertical movement of the bar or bars upon opening of one drawer locks the other drawers against opening. Usually the vertical bar movement is accomplished by engagement between a ramp surface on the drawer and a lock member on the bar. Quite often all of these components are made of metal and the friction that is generated during operation of the interlock can generate noise during the operation.

The prior art also discloses locking mechanisms for security locking all of the drawers of a file cabinet. Such mechanisms have also utilized a vertically extending bar or bars located at opposite sides of the file cabinet.

References which disclose file cabinets having interlocks and locking mechanisms of the type described above include U.S. Pat. Nos. 2,793,927; 2,829,021; 3,323,849; 3,764,190; 3,866,993; 3,870,387; 3,888,558; and 3,969,008.

DISCLOSURE OF INVENTION

An object of the present invention is to provide a file cabinet having an improved drawer interlock including a plurality of lock members of a unique construction that are associated with the cabinet drawers to provide locking thereof and which are mounted on an interlock bar that is slidably supported on an inner panel spaced inwardly from a side panel of the cabinet.

Another object of the present invention is to provide a file cabinet having a drawer interlock according to the previous object and including a lock mechanism that cooperates with the interlock to selectively lock all of the drawers in closed position for security by movement of the interlock bar.

In carrying out the above objects, the drawer interlock preferably includes a pair of the interlock bars, one supported on one side panel of the cabinet by an adjacent inner panel and operable to lock one side of the drawers, and the other supported on the other side panel of the cabinet by an adjacent inner panel and operable to lock the other side of the drawers. However, it should be understood that the interlock and the lock mechanism can function satisfactorily with only one interlock bar at one side of the cabinet depending upon the type of cabinet involved. For example, normal file cabinets whose drawers have a width of approximately 15 to 18 inches are more adaptable for use with a single interlock bar while "lateral" file cabinets having a drawer width of approximately 3 to 4 feet function best if two interlock bars are utilized.

Each lock member preferably has a unitary plastic construction that provides good lubricity in order to facilitate operation of the drawer interlock and operation of the lock mechanism in cooperation with the interlock. The lock members are located laterally inward from their associated side panels and each includes a vertically elongated guide that extends outwardly in a lateral direction between spaced slides preferably embodied by flanges of a plastic sleeve that is mounted in a channel-shaped support section of the adjacent inner panel. The interlock bar is slidably received within the plastic sleeve and preferably has a channel shape. Threaded bolts extend through the lock members and hence between the spaced slide flanges of the plastic sleeve to be received by threaded holes of the interlock bar in order to fixedly mount the lock members on the bar. Cooperation of the elongated guides of the lock members slidably supports each interlock bar on the slide flanges of the associated plastic sleeve for translational movement in a vertical direction between upper and lower positions.

A pair of upwardly extending hooks of each lock member are located laterally inward from the adjacent inner panel. One forwardly extending hook is received within a keeper opening in the adjacent side of the drawer that is aligned with the lock member when the bars are in the lower position. Another rearwardly extending hook allows the lock member to be used on either side of the cabinet so that right and left versions are not required. Positioning surfaces on the plastic lock members and the interlock bar engage the opposite sides of the spaced slide flanges on the plastic sleeve to support the interlock bar for movement between lower and upper positions. Actuators on the drawer sides each include a ramp that engages a slide surface of the associated lock member upon opening drawer movement so as to move the interlock bar to its upper position such that the hooks of the other lock members mounted thereon lock the other drawers in their closed position. A horizontal slideway of each drawer actuator engages the slide surface of the associated lock member upon further drawer opening to maintain the interlock bar in its upper position until the drawer is again closed.

A lock mechanism of the file cabinet cooperates with the upper end of each interlock bar to provide locking for security purposes. Each interlock bar has an upper end that includes an opening and an inclined flange located above its opening. The inclined flange extends upwardly in a laterally outward direction with respect to the file cabinet. Actuator members of the lock mechanism have outer ends received within the openings in the upper ends of the interlock bars below the inclined flanges of the bars. Inclined surfaces of the actuator members engage the flanges in a surface-to-surface contact. A lock operates the mechanism to pull the actuator members inwardly so that the sliding engagement between the inclined flanges and the inclined surfaces moves the interlock bars upwardly such that the hooks of the lock members on the interlock bars engage all of the drawers to prevent opening of any one. Operation of the lock also moves the actuator members outwardly to allow the force of gravity acting on the interlock bars to move the bars downwardly and thereby unlock the drawers for opening under the control of the interlock. Of course, only a single actuator member is necessary for a cabinet having a single interlock bar that locks only one side of each drawer by the lock members.

In its preferred construction, the lock member has a pair of positioning surfaces spaced from each other with the vertically elongated guide of the lock member therebetween such that the positioning surfaces are slidably engaged with the spaced slide flanges on opposite sides of the elongated guide received between the slide flanges. The hooks of each lock member are located laterally inward from the positioning surfaces thereof and the positioning surfaces maintain a spaced relationship between the hook and the inner panel on which the associated plastic sleeve is mounted. Elimination of metal-to-metal contact mitigates noise upon upward and downward movement of the interlock bar.

Each of the plastic lock members includes a locating projection that is received within an associated positioning hole in the interlock bar on which it is mounted upon threading of the bolt that secures the lock member on the bar. Cooperation between the locating projection and the positioning hole in which it is received thus prevents rotation of the lock member during use upon attempted opening of the drawer when it is locked by either interlock or lock mechanism actuation. If for any reason the positioning projection on the lock member should break off due to excessive force applied during the attempted drawer opening, the engagement between the elongated guide of the lock member and the vertically elongated slide flanges of the plastic sleeve will then prevent rotation of the lock member on the interlock bar.

The slide surface on each plastic lock member preferably includes a ramp surface portion on each hook. The ramp surface portion on the rear hook is engaged by the ramp of the drawer actuator. The slide surface portion on each plastic lock member also includes a horizontal surface portion that extends between the ramp surface portions and is engaged by the horizontal slideway of the drawer actuator. During opening of any one drawer with the others closed, the drawer ramp first engages the ramp surface of the rear hook on the associated lock member to move the lock member and the interlock bar on which it is mounted upwardly. The other lock members on the interlock bar are thus moved upwardly so that their hooks are received within the aligned keeper openings in the adjacent sides of the drawers. As the one drawer continues to move outwardly in an opening direction, the horizontal slideway of the actuator engages the horizontal surface portion of the one lock member in order to maintain the interlock bar in its upper position locking all of the other drawers against opening. Upon subsequent closing movement of the one drawer, the horizontal slideway of the drawer actuator and the horizontal surface portion of the slide surface on the associated locking member remain engaged until just before the drawer reaches its closed position whereupon the ramp of the drawer actuator and the ramp surface portion on the rear hook of the locking member are slidably engaged in order to allow downward movement of the interlock bar and unlocking of the other drawers as the drawer is completely closed.

The objects, features, and advantages of the present invention are readily apparent from the following description of the best mode for carrying out the invention when taken in connection with the accompanying drawings.

BEST MODE FOR CARRYING OUT THE INVENTION

Figure 1:
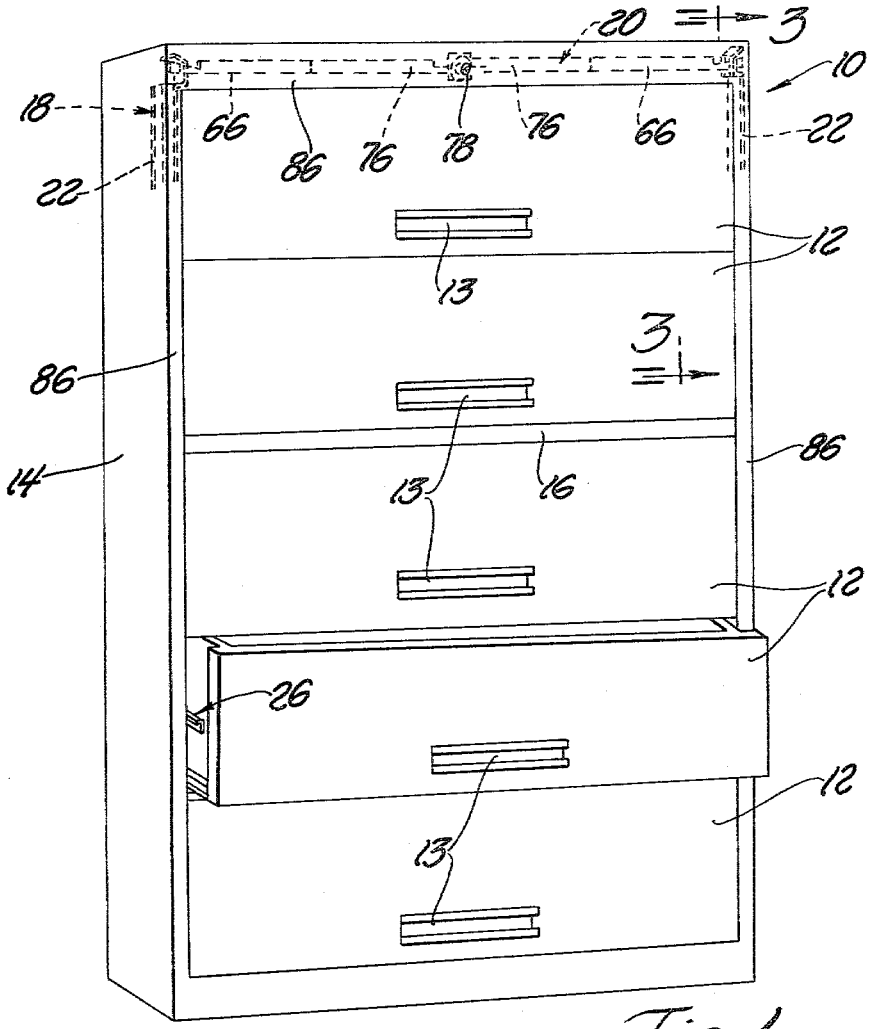
FIG. 1 is a perspective view of a file cabinet having a drawer interlock and a security lock mechanism constructed in accordance with the present invention.

Referring to FIG. 1, a file cabinet that is constructed in accordance with the present invention is generally indicated by reference numeral 10 and includes vertically arranged drawers 12 that are slidably mounted for movement between open and closed positions in a conventional manner. Handles 13 of the drawers 12 are grasped to move the drawers which are located intermediate side panels 14 of the cabinet and, as shown, have a width that is much greater than their height or depth. This type of file cabinet is referred to as a "lateral" file cabinet and is usually utilized to store files whose planes extend forwardly and rearwardly as opposed to side-to-side as is the case with the more conventional file cabinet. Between the third and fourth drawers 12, a reference shelf 16 is slidably mounted for movement between the stored position shown and a forwardly projecting use position. Opening movement of the drawers 12 is controlled by an interlock 18 illustrated in FIGS. 3 through 7 and by a lock mechanism 20 that is illustrated in FIG. 2 and which cooperates with the interlock to provide security locking of all the drawers.

Figure 2:
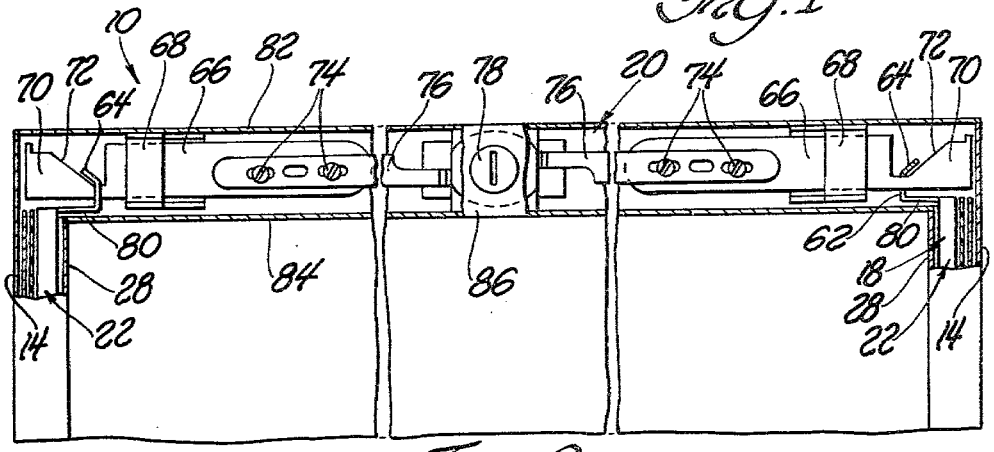
FIG. 2 is a front elevation view of a top portion of a cabinet taken partially in section to illustrate the lock mechanism.

As seen in FIGS. 1 and 2, the drawer interlock 18 disclosed includes a pair of vertically extending interlock bars 22 respectively located adjacent the side panels 14 at opposite sides of each drawer 12. While it is possible for the interlock 18 to function with a single interlock bar 22 whose operation is hereinafter described, it is preferable to have two of the interlock bars for file cabinets of the type with the relatively wide drawers shown. Lock members 24 (FIGS. 3 and 4) mounted on each of the interlock bars 22 support the bar for vertical movement between a lower position to which it is biased by gravity and an upper position where a drawer interlock operation takes place. Briefly, with the drawer interlock in the unlocked condition of FIG. 3, any one of the drawers 12 can be opened by a forward pulling movement. Upon such opening as shown in FIG. 4, an actuator 26 on the drawer being opened cooperates with the associated lock member 24 to move the interlock bar 22 upwardly so that the other lock members 24 lock the other drawers from being opened. All of the other drawers remain locked in the closed position until the one opened drawer is again closed. This interlock operation prevents the center of gravity of the file cabinet from moving so far forward as to possibly tip the cabinet over forwardly.

Figure 4:
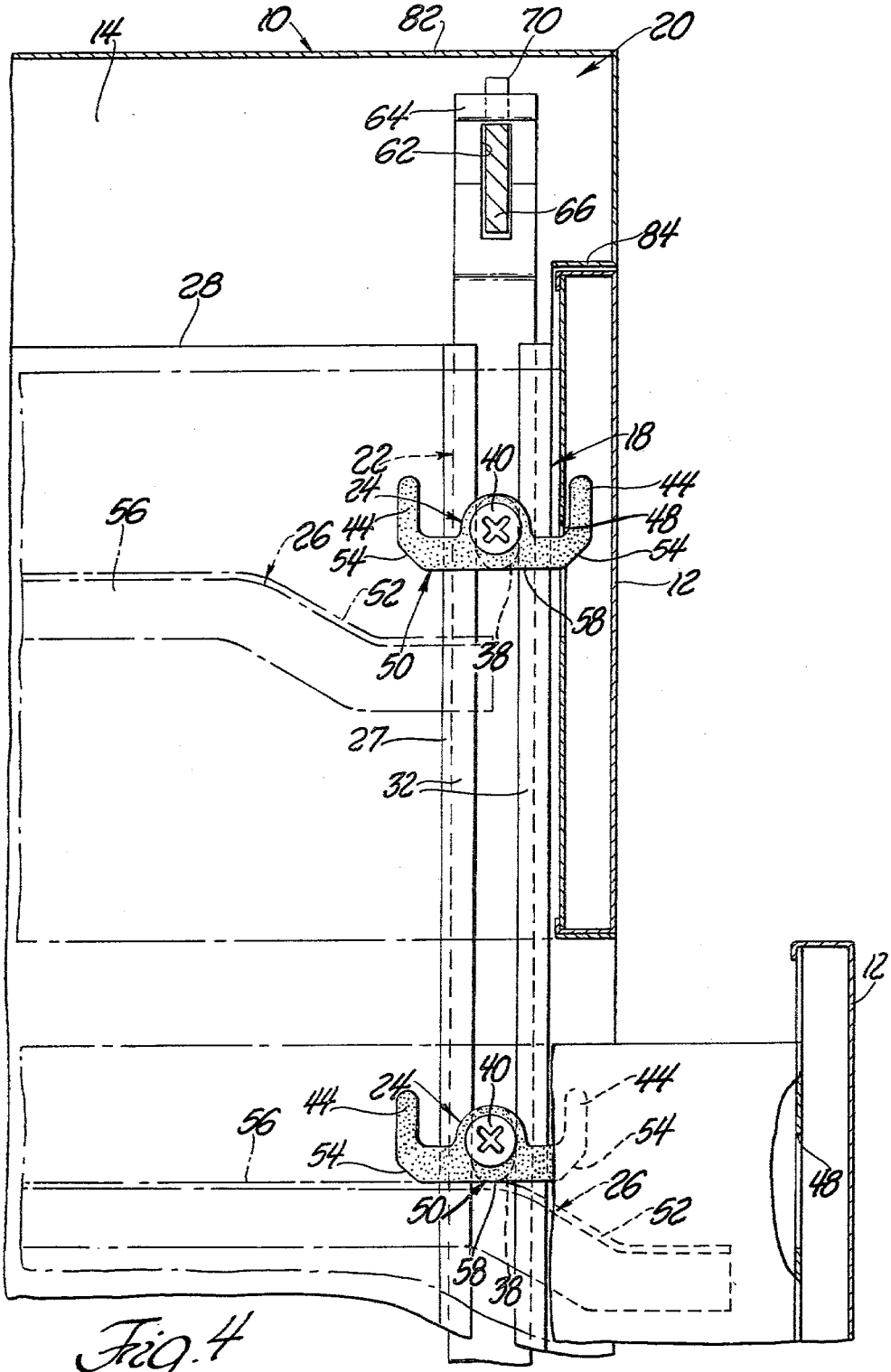
FIG. 4 is a view similar to FIG. 3 but with one of the drawers shown partially opened so that the interlock is locked in order to prevent the other drawers from opening.
Figure 5:
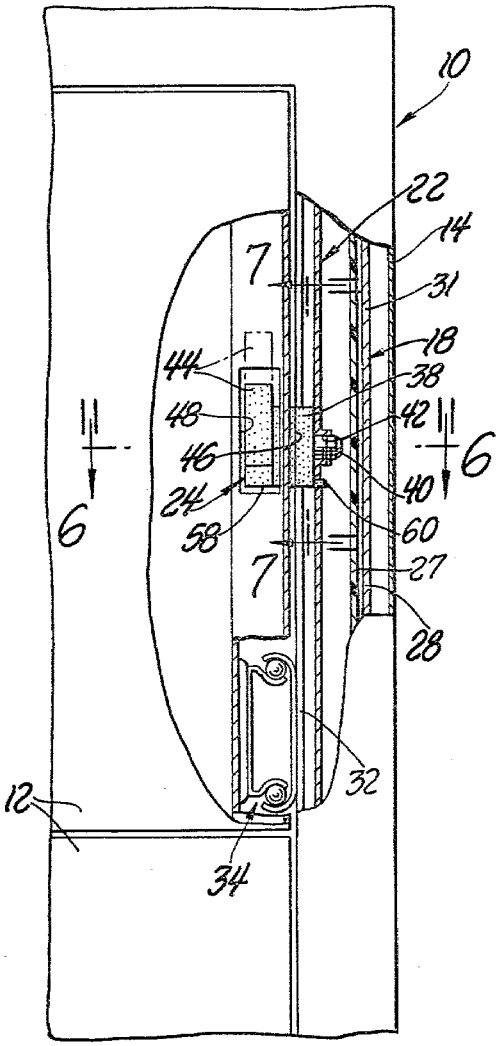
FIG. 5 is a front elevation view of one side of the filing cabinet shown partially broken away to illustrate the drawer interlock.
Figure 6:
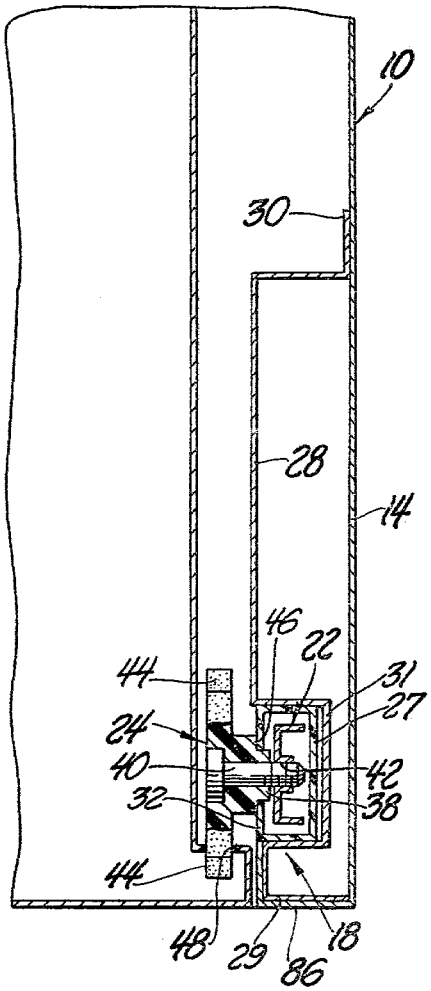
FIG. 6 is a top plan view taken in section along line 6—6 of FIG. 5.

As seen by combined reference to FIGS. 5 and 6, each interlock bar 22 is received within a plastic sleeve 27 on an associated inner panel 28 whose front flange 29 is positioned within a rearwardly flanged front portion of side panel 14 and whose rear flange 30 (FIG. 6) is welded to the associated side panel. A channel-shaped support section 31 of inner panel 28 receives and supports the plastic sleeve 27 in which the interlock bar 22 is received. Plastic sleeve 27 has a channel shape and includes a pair of slide flanges 32 that provide spaced slides which extend vertically to support the interlock bar for vertical movement. Conventional antrifraction drawer slide assemblies 34 shown in FIG. 5 mount the sides of each drawer 12 on the inner panel 28 for forward opening movement and rearward closing movement in the normal fashion. Lock members 24 and the slide flanges 32 of plastic sleeve 27 cooperate to support the interlock bar 22 on the associated inner panel 28 for upward and downward vertical movement between the unlocked condition of FIG. 3 and the locked condition of FIG. 4. The elimination of metal-to-metal contact in providing such support mitigates noise upon upward and downward movement.

Figure 7:
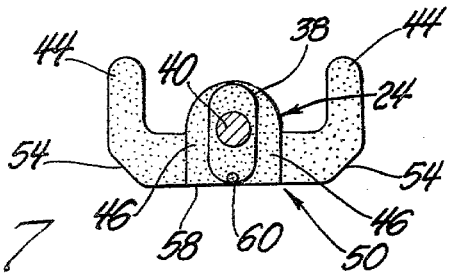
FIG. 7 is an elevation view taken in the direction of line 7—7 of FIG. 5 and illustrates a lock member of the drawer interlock.

As seen by combined reference to FIGS. 5, 6, and 7, each lock member 24 preferably has a unitary plastic construction and is most preferably injection molded from polycarbonate plastic. A vertically elongated guide 38 of the lock member 24 has an oblong shape as best seen in FIG. 7 and extends laterally in an outward direction between the slide flanges 32 of the plastic sleeve 27. A threaded bolt 40 extends through a bolt hole in the lock member 24 as best seen in FIG. 6 and is threaded into a threaded hole 42 in the interlock bar 22 in order to fixedly secure the lock member onto the interlock bar. Lock member 24 is symmetrical about a vertical centerline therethrough as viewed in FIG. 7 so as to be usable on both the right and left sides of the cabinet and includes a pair of hooks 44 located inwardly from the inner panel 28. One hook 44 extends forwardly and upwardly to provide locking action with the adjacent drawer. The other hook 44 extends rearwardly and upwardly and is likewise operable to lock a drawer when the associated locking member is used on the other side of the cabinet. Spaced positioning surfaces 46 of lock member 24 are located on opposite sides of the oblong guide 38 as shown in FIG. 7 and slidably engage the spaced slide flanges 32 of the plastic sleeve 27 as seen in FIG. 6 as does the interlock bar 22 to laterally locate the hooks 44 of the lock members 24 inwardly from the panel 28 during upward and downward movement as interlock operation of the drawers takes place. It will be noted that the interlock bar 22 has a channel-shaped cross section as shown in FIG. 6 in order to provide rigidity; but, it is understood that other cross sections may be utilized to provide the same function of interconnecting the lock members 24 associated with each drawer.

Figure 3:
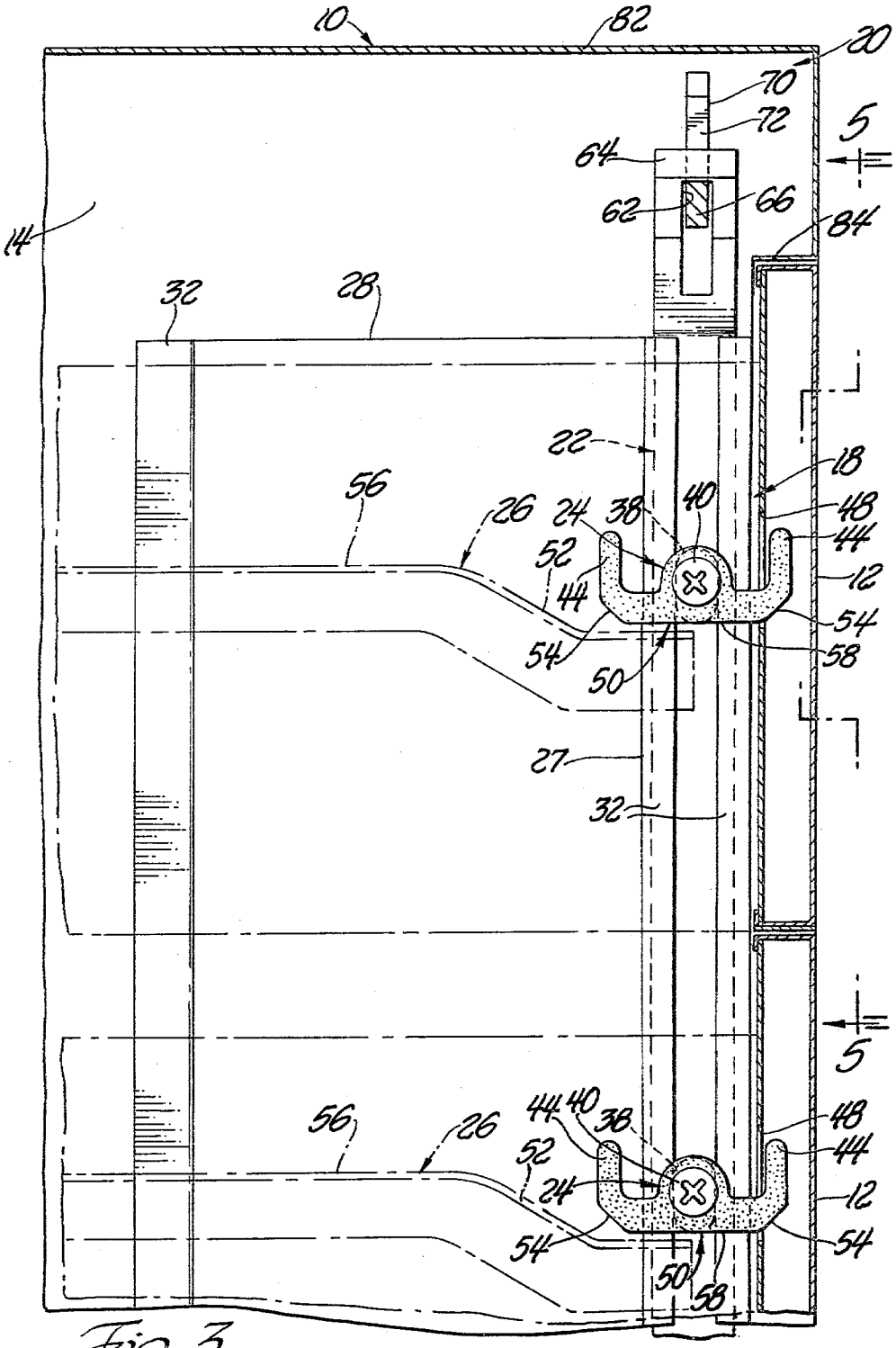
FIG. 3 is a sectional view taken in section along line 3—3 of FIG. 1 and illustrates the drawer interlock in an unlocked condition.

When all of the file cabinet drawers are closed, the interlock 18 is in an unlocked condition as shown in FIG. 3 with the interlock bar in a lower position toward which it is biased solely by gravity. Each of the lock members 24 then has its forward hook 44 extending upwardly within a keeper opening 48 formed in a side flange of the adjacent drawer as can be best understood by additional reference to FIG. 6. The upper edge of each keeper opening 48 is located above the upper end of the hook 44 on the associated lock member 24 so that any one drawer can be initially pulled out in order to gain access to the drawer. Such outward movement slidably engages the actuator 26 on the adjacent side of the drawer with a slide surface 50 on the aligned lock member 24. The initial outward drawer movement first moves the keeper opening 48 on the one drawer being opened forwardly past the forward hook 44 of the adjacent lock member 24. A ramp 52 on the drawer actuator 26 then slidably engages a ramp portion 54 on the slide surface 50 at the rear hook 44 of the lock member 24. Slidable engagement between the ramp 52 and the ramp surface portion 54 moves the one lock member 24 upwardly between the spaced slides 32 of the plastic sleeve 27 to the position shown in FIG. 4 and the interlock bar 22 simultaneously moves to an upper position in order to move all of the other lock members 24 upwardly so that their forward hooks 44 are located above the upper edge of their associated keeper openings 48 on the drawers. Consequently, each other drawer 12 is then locked against forward movement since attempted opening is limited by the lock member hook 44 at each side of the drawer. A ramp surface portion 54 on the front hook 44 functions in the same manner when the lock member is used on the other side of the cabinet. Continued outward movement of the one drawer 12 that is opened as shown in FIG. 4 slidably engages a horizontal slideway 56 of the drawer actuator 26 with a horizontal portion 58 of the slide surface 50 that extends between the ramp surface portions 54 on the lock member 24. As such, the interlock bar 22 and the lock members 24 are maintained in the upper position locking all of the other drawers as the one drawer is opened to its full extent.

Upon closing of the one opened drawer shown in FIG. 4, the horizontal slideway 56 on the drawer actuator 26 and the horizontal portion 58 of the slide surface 50 remain in engagement until the ramp 52 of the actuator and the ramp portion 54 of the slide surface slidably engage each other whereupon the interlock bar 22 is allowed to move downwardly under the bias of gravity as the drawer closing continues. Upon the drawer reaching the closed position, the interlock bar 22 will have first reached its lower position so that each lock member 24 has its hook 44 positioned as in FIG. 3 within the associated drawer keep opening 48. Any drawer can then again be opened and the same interlock action takes place during the opening. Of course, it is understood that both interlock bars move upwardly and downwardly with each other when two bars are utilized as herein disclosed.

Each of the lock members 24 includes a locating projection 60 that extends from its guide 38 as best seen in FIGS. 5 and 7. Upon mounting of each lock member 24 on the interlock bar 22, its locating projection 60 is received within an associated positioning hole located adjacent the threaded bolt hole 42. Positioning projection 60 thus rotatably locates the lock member 24 on the interlock bar during use. If stress applied to the lock member 24 causes the locating projection 60 to break off, the oblong shape of the guide 38 on the lock member and the complementary shape of the spaced slide flanges 32 between which it is received will prevent the lock member 24 from rotating on the interlock bar 22. Thus, the interlock 18 will remain operable even if the locating projection 60 on one or more of the lock members 24 should break. Also, the oblong shape of the guide 38 on each lock member provides upward and downwardly translational movement of the interlock bar 28 during the interlock operation with the frictional stress between the guide 38 and the slide flanges 32 reduced as a result of the vertically elongated shape of the guide. Plastic such as polycarbonate plastic which is the preferred material for the lock members 24 will provide good lubricity for the upward and downward movement of the interlock bar and also provides good lubricity between the drawer actuator 26 and the lock member 24. Polycarbonate plastic also has particularly high strength characteristics for preventing possible breakage of the lock member during use.

With combined references to FIGS. 2 and 3, the lock mechanism 20 cooperates with the interlock 18 in order to selectively provide security locking of all of the drawers 12 in the closed position. The upper end of each interlock bar 22 includes an opening 62 (FIG. 3) and an inclined flange 64 (FIG. 2) that is located above the opening extending upwardly in a lateral outward direction with respect to the adjacent side of the file cabinet. A pair of actuator members 66 of the lock mechanism 20 are slidably supported by depending slide mounts 68 for movement inwardly and outwardly in a lateral direction with respect to the cabinet. An outer end 70 of each actuator member 66 is received by the opening 62 in the upper end of the adjacent interlock bar 22 and includes an inclined surface 72 that extends upwardly in an outward direction so as to slidably engage the associated bar flange 64 with a surface-to-surface contact. Inner ends of the actuator members 66 are secured by adjustable bolt and slot connections 74 to a pair of control members 76 that are moved inwardly and outwardly by a lock 78 which is preferably of the key operated type.

When all of the file cabinet drawers 12 are closed, the lock mechanism 20 is operated by the key lock 78 to move the control members 76 and hence the actuator members 66 connected thereto inwardly toward each other so that the inclined surfaces 72 slidably move the inclined flanges 64 of the interlock bars 22 upwardly to the locked condition. Each of the lock members 24 is thus moved so its forward hook 44 is positioned above the upper side of the associated drawer keeper opening 48 as shown by the upper drawer 12 in FIG. 4. Locking of the drawers in this manner provides a security function that prevents unauthorized access to the file drawers. Key operation of lock 78 in the opposite direction moves the control members 76 and the actuator members 66 outwardly away from each other so that the inclined flanges 64 slide downwardly on the inclined surfaces 72 and thereby allow the interlock bars 22 to move downwardly and unlock the drawers 12 for opening movement.

It should be noted in FIG. 2 that the upper ends of the interlock bars 22 on which the openings 62 and inclined flanges 64 are provided have inwardly extending flanges 80 that extend above and inwardly over the adjacent inner panels 28 at the opposite sides of the cabinet. A top outer panel 82 of the cabinet on which the mounts 68 are supported and a top inner panel 84 are connected by a front face panel 86 to provide a housing for the lock mechanism. Face panel 86 extends about the front periphery of the file cabinet as shown in FIG. 1 so as to also connect the side and inner panels 14 and 28. As seen in FIG. 6, the face panel 86 is located adjacent the front flange 30 of the inner panel 28 and is preferably secured thereto by a welding operation.

As is apparent from the foregoing description, the drawer interlock 18 has utility in preventing a drawer from being opened when another one is already opened and the lock mechanism 20 that cooperates with the interlock likewise has utility for security purposes in locking all of the drawers in the closed position. The particular manner in which both the interlock and the lock mechanism operate provides effective drawer interlock operation and security locking with an uncomplicated structure whose operation is facilitated due to the construction of the components disclosed.

While the best mode for carrying out the invention has herein been described in detail, those familiar with the art to which this invention relates will recognize various alternative ways for practicing the invention as defined by the following claims.

What is claimed is:

1. In a file cabinet having side panels and a plurality of vertically arranged drawers supported between the side panels for movement between open and closed positions, an interlock for the drawers comprising: an inner panel fixedly mounted on one of the side panels; spaced slides extending vertically on the inner panel; a vertically extending interlock bar positioned between the slides and the adjacent side panel; a plurality of lock members respectively associated with the drawers; each lock member including a vertically elongated guide that extends outwardly between the spaced slides and is fixedly secured to the interlock bar so as to support the bar for translational movement in a vertical direction between lower and upper positions; each lock member also including an upwardly extending hook located laterally inward from the spaced slides on the inner panel so as to engage the associated drawer in the closed position thereof with the bar in its upper position in order to maintain the drawer closed; each drawer being movable to the open position thereof free of the associated lock member hook with the bar in its lower position toward which gravity biases the bar; each lock member having a slide surface located laterally inward from the inner panel; an actuator on each drawer including a ramp that engages the slide surface of the associated lock member upon an initial opening drawer movement so as to move the interlock bar to its upper position and thereby lock each other drawer in its closed position; and each actuator also including a horizontal slideway that engages the slide surface on the associated lock member upon further drawer opening to maintain the interlock bar in its upper position until the drawer is closed whereupon the bar moves to its lower position so that any selected drawer can then be opened.

2. A cabinet as in claim 1 further including an upper end on the interlock bar which includes an opening and an inclined flange above said opening, a lock mechanism including an actuator member received within the opening in the upper end of the interlock bar, the actuator member including an inclined surface that engages the inclined flange on the interlock bar, and lock means for moving the actuator member such that the inclined surface thereof slides against the inclined flange on the interlock bar in order to provide upward movement thereof to lock each drawer in the closed position.

3. A cabinet as in claim 1 wherein the inner panel includes a support section, a plastic sleeve that is mounted by the support section of the inner panel and which includes flanges that comprise the spaced slides, and the interlock bar being received within the sleeve.

4. A cabinet as in claim 3 wherein each lock member includes a pair of positioning surfaces spaced from each other with the vertically elongated guide of the lock member therebetween such that the positioning surfaces respectively engage the spaced slide flanges on the plastic sleeve, and the hook of each lock member being located laterally inward from the positioning surfaces thereof such that the positioning surfaces maintain a spaced relationship between the hook and the plastic sleeve on the inner panel.

5. A cabinet as in claim 4 wherein each lock member includes a locating projection and wherein the interlock bar includes vertically spaced positioning holes respectively associated with the lock members so as to receive the locating projections of the lock members.

6. A cabinet as in claim 5 wherein the interlock bar includes threaded holes adjacent and respectively associated with the positioning holes, each lock member having a bolt hole therethrough, and threaded bolts that extend through the lock members into the threaded holes of the interlock bar so as to retain the lock members to the bar with the locating projections of the lock members received within the positioning holes of the bar in order to prevent rotation of the lock members.

7. A cabinet as in claims 1 or 6 wherein each lock member includes a pair of hooks so as to be usable on either side of the cabinet, the slide surface on each lock member including a ramp surface portion on each hook so that one of said ramp surface portions is engaged by the ramp of the drawer actuator upon the initial opening drawer movement, and the slide surface on each lock member also including a horizontal surface portion that is engaged by the horizontal slideway of the drawer actuator during subsequent opening movement of the drawer.

8. A cabinet as in claim 7 wherein each drawer includes a side edge having a rearwardly facing keeper opening that receives one hook of the associated lock member, and each keeper opening including an upper side where the drawer is engaged by the associated lock member hook upon upward movement of the interlock bar when the drawer is in its closed position.

9. In a file cabinet having a pair of side panels and a plurality of vertically arranged drawers supported between the side panels for movement between opened and closed positions, an interlock for the drawers comprising: a pair of inner panels respectively mounted in a fixed relationship on the side panels; each inner panel including a channel-shaped support section; a pair of plastic sleeves respectively mounted by the support sections of the inner panels; each plastic sleeve including a pair of spaced slide flanges; a pair of vertically extending interlock bars respectively received within the plastic sleeves on the inner panels; a plurality of lock members respectively associated with the sides of each drawer; each lock member having a unitary plastic construction including a vertically elongated guide that extends between the spaced slide flanges on the associated sleeve and which is fixedly secured to the adjacent interlock bar so as to support the bar for translational movement in a vertical direction between lower and upper positions; each lock member also including an upwardly extending hook located laterally inward from the adjacent inner panel; the lock members associated with each drawer having the hooks thereof engaged therewith when the drawer is closed with the interlock bars in their upper position so as to thereby maintain the drawer closed; each drawer being movable to the open position thereof free of the associated lock members hooks with the interlock bars in their lower position toward which gravity biases the bars; each lock member having a slide surface located laterally inward from the adjacent inner panel; an actuator on each side of each drawer; each actuator including a ramp that engages the slide surface of the associated lock member upon an initial opening drawer movement so as to move the interlock bars to their upper position and thereby lock the sides of each other drawer in the closed position; and each actuator also including a horizontal slideway that engages the slide surface on the associated lock member upon further drawer opening to maintain the interlock bars in their upper position until the opened drawer is subsequently closed whereupon the bars move to their lower position so that any selected drawer can then be opened.

10. In a file cabinet having a pair of side panels and a plurality of vertically arranged drawers supported between the side panels for movement between open and closed positions, an interlock for the drawers comprising: a pair of inner panels respectively mounted in a fixed relationship on the side panels; each inner panel including a channel-shaped support section; a pair of plastic sleeves respectively mounted by the support sections of the inner panels; each plastic sleeve including a pair of spaced slide flanges; a pair of vertically extending interlock bars respectively received within the plastic sleeves on the inner panels; a plurality of lock members respectively associated with the sides of each drawer; each lock member having a unitary plastic construction including a vertically elongated guide that extends between the spaced slide flanges on the associated sleeve and which is fixedly secured to the adjacent interlock bar so as to support the bar for translational movement in a vertical direction between lower and upper positions; each lock member also including a pair of upwardly extending hooks located laterally inward from the adjacent inner panel; keeper openings respectively associated with the sides of each drawer so that the one hook of each lock member is engaged with the closed drawers when the interlock bars are in their upper position to thereby maintain the drawers closed; each drawer being movable to the open position thereof free of the associated lock member hooks with the interlock bars in their lower position toward which gravity biases the bars; each lock member having a slide surface located laterally inward from the adjacent inner panel in a spaced relationship; the slide surface of each lock member including a ramp surface portion on each hook and a horizontal surface portion extending between the hooks; each lock member including a pair of spaced positioning surfaces with the guide thereof located between the positioning surfaces thereof; the positioning surfaces respectively engaging the spaced slide flanges on the associated sleeve to position the hooks and slide surfaces inwardly from the inner panels; an actuator on each side of each drawer; each actuator including a ramp that engages one ramp surface portion of the associated lock member slide surface upon an initial opening drawer movement so as to move the interlock bars to their upper position and thereby lock the sides of each other drawer in the closed position; and each actuator also including a horizontal slideway that engages the horizontal surface portion on the associated lock member slide surface upon further drawer opening to maintain the interlock bars in their upper position until the opened drawer is subsequently closed whereupon the bars move to their lower position so that any selected drawer can then be opened.

11. A cabinet as in claim 10 wherein each interlock bar includes an upper end which has an opening and also includes an inclined flange above the opening thereof, each of said flanges being inclined upwardly in a laterally outward direction with respect to the cabinet, a lock mechanism including a pair of actuator members respectively associated with the interlock bars, each actuator member having an end which is received within the opening of the associated interlock bar and which has an inclined surface that is engageable with the inclined flange of the bar, the inclined surface of each actuator member extending upwardly in a laterally outward direction with respect to the file cabinet, and the lock mechanism including lock means for selectively moving the actuator members inwardly toward each other such that the inclined surfaces on the ends thereof move the interlock bars upwardly to lock each drawer in the closed position.

* * * * *